US010421585B2

(12) United States Patent
Collins

(10) Patent No.: US 10,421,585 B2
(45) Date of Patent: Sep. 24, 2019

(54) OVERCAP FOR A BOTTLE HAVING AN INNER SKIRT AND OUTER SKIRT

(71) Applicant: CORE NUTRITION, LLC, Beverly Hills, CA (US)

(72) Inventor: Lance Collins, Beverly Hills, CA (US)

(73) Assignee: Core Nutrition, LLC, Plano, TX (US)

( * ) Notice: Subject to any disclaimer, the term of this patent is extended or adjusted under 35 U.S.C. 154(b) by 64 days.

(21) Appl. No.: 15/476,349

(22) Filed: Mar. 31, 2017

(65) Prior Publication Data

US 2018/0282028 A1 Oct. 4, 2018

(51) Int. Cl.

| | |
|---|---|
| ***B65D 41/62*** | (2006.01) |
| ***B65D 41/04*** | (2006.01) |
| ***B65D 1/02*** | (2006.01) |
| ***B65D 51/24*** | (2006.01) |

(52) U.S. Cl.

CPC ..... *B65D 41/62* (2013.01); *B65D 1/0207* (2013.01); *B65D 1/0246* (2013.01); *B65D 41/04* (2013.01); *B65D 51/245* (2013.01)

(58) Field of Classification Search

CPC ..... B65D 51/18; B65D 2251/0015; B65D 41/62; B65D 41/04; B65D 41/26; B65D 1/0246

See application file for complete search history.

(56) References Cited

U.S. PATENT DOCUMENTS

| | | | | |
|---|---|---|---|---|
| 1,986,741 A | | 1/1935 | Moser et al. | |
| 4,230,230 A | | 10/1980 | Mumford | |
| 4,378,891 A | | 4/1983 | Fowles et al. | |
| 4,535,906 A | * | 8/1985 | Rowekamp | B65D 41/0471 215/329 |
| 4,544,073 A | | 10/1985 | Willis | |
| 4,565,294 A | | 1/1986 | Smith et al. | |
| 4,709,823 A | | 12/1987 | Beck | |
| 4,966,780 A | * | 10/1990 | Hargraves | B65D 51/1616 215/375 |
| 5,096,078 A | * | 3/1992 | McQueeny | B65D 51/26 206/522 |
| 5,269,426 A | | 12/1993 | Morano | |
| 5,927,567 A | | 7/1999 | Fillmore | |

(Continued)

FOREIGN PATENT DOCUMENTS

| | | |
|---|---|---|
| DE | 19708909 A1 | 9/1998 |
| EP | 1025014 B1 | 9/2004 |

(Continued)

OTHER PUBLICATIONS

English Abstract of DE19708909, Publication Date: Sep. 10, 1998.

(Continued)

*Primary Examiner* — Shawn M Braden

(74) *Attorney, Agent, or Firm* — Pizarro Allen PC

(57) ABSTRACT

A bottle includes a body and an overcap that covers the shoulder and neck of the bottle. The overcap includes an outer skirt and an inner skirt. The inner skirt engages the closure for the bottle. The outer skirt extends outwardly from the inner skirt. The inner skirt includes a first engaging lip and a second engaging lip that secure the overcap to the body of the bottle. The first engaging lip is located below the cover of the closure while the second engaging lip is located below the tamper-proof band of the closure.

20 Claims, 6 Drawing Sheets

(56) References Cited

U.S. PATENT DOCUMENTS

| | | | | |
|---|---|---|---|---|
| 5,975,369 | A | 11/1999 | Yurkewicz et al. | |
| 6,050,436 | A | 4/2000 | Bennett et al. | |
| 6,321,924 | B1 | 11/2001 | Yurkewicz et al. | |
| 6,595,395 | B2 | 7/2003 | Jourdin et al. | |
| 6,758,359 | B2 | 7/2004 | Yurkewicz et al. | |
| 7,296,700 | B2 | 11/2007 | Steele, IV et al. | |
| 7,909,204 | B2 | 3/2011 | Antal, Sr. | |
| 7,954,521 | B2 | 6/2011 | Py et al. | |
| 7,988,004 | B1 | 8/2011 | Marret et al. | |
| 8,020,719 | B2 | 9/2011 | Maiwald et al. | |
| 8,074,817 | B1 * | 12/2011 | Steele, IV | B65D 23/102 206/828 |
| 8,479,936 | B2 * | 7/2013 | Gruenwald | B65D 51/28 215/253 |
| 9,022,079 | B2 | 5/2015 | Py et al. | |
| 9,162,803 | B2 | 10/2015 | Rosenquist | |
| 9,254,943 | B2 * | 2/2016 | Brooks | B65D 41/28 |
| 9,382,044 | B2 | 7/2016 | Chanas et al. | |
| 9,505,533 | B2 | 11/2016 | Aneas | |
| 2003/0230546 | A1 | 12/2003 | Yurkewicz et al. | |
| 2005/0167430 | A1 | 8/2005 | Varadarajan | |
| 2006/0231519 | A1 | 10/2006 | Py et al. | |
| 2008/0011703 | A1 | 1/2008 | Schmeisser et al. | |
| 2011/0303670 | A1 | 12/2011 | Baker | |
| 2012/0186697 | A1 | 7/2012 | Py et al. | |
| 2016/0090205 | A1 | 3/2016 | Py et al. | |
| 2016/0166473 | A1 | 6/2016 | Young | |

FOREIGN PATENT DOCUMENTS

| | | | |
|---|---|---|---|
| EP | 1888424 | A2 | 2/2008 |
| GB | 2358180 | A | 7/2001 |
| GB | 2403202 | A | 12/2004 |
| GB | 2445035 | B1 | 8/2012 |
| KR | 1645615 | B1 | 8/2016 |
| WO | 2006064069 | A1 | 6/2006 |
| WO | 2011018593 | A1 | 2/2011 |
| WO | 2014027602 | A1 | 2/2014 |

OTHER PUBLICATIONS

English Abstract of WO2014027602, Publication Date: Feb. 20, 2014.

English Abstract of WO2011018593, Publication Date: Feb. 17, 2011.

English Abstract of KR1645615, Publication Date: Aug. 5, 2016.

* cited by examiner

OVERCAP FOR A BOTTLE HAVING AN INNER SKIRT AND OUTER SKIRT

FIELD OF THE INVENTION

The present invention relates to bottles to hold fluids having an overcap. More particularly, the present invention relates to an overcap for a bottle having an outer skirt and an inner skirt that engages a neck of the bottle.

DESCRIPTION OF THE RELATED ART

Drink bottles hold water or other fluids to replenish one during activities. Consumers drink more water and fluids using these bottles. Some bottles have overcaps that cover the closure of the bottle for an easier grasp when carrying the bottle during activities. One problem with the use of an overcap is that it tends to dislodge from attachment with the body of the bottle. The body falls away from the overcap when held or pulled by a user.

SUMMARY OF THE INVENTION

According to some embodiments, bottle is disclosed. The bottle includes a body to hold a fluid. The bottle also includes a base located below the body. The bottle also includes a shoulder located opposite the base and connected to the body. The bottle also includes a neck connected to the shoulder. The neck includes a finish and a collar. The bottle also includes a mouth within the neck to allow access to the body. The bottle also includes a closure to engage the finish so as to close the mouth. The closure includes a cover and a tamper-proof band. The bottle also includes an overcap coupled with the closure. The overcap includes an outer skirt to flare outwardly from the mouth to cover the neck and the shoulder. The overcap also includes an inner skirt to engage the cover and the tamper-proof band. The inner skirt includes a first engaging lip to engage the cover and a second engaging lip to engage the tamper-proof band.

In other embodiments, an overcap to engage a closure and a tamper-proof band of a bottle is disclosed. The overcap includes an inner skirt to engage the cover and the tamper-proof band. The inner skirt includes a first engaging lip and a second engaging lip. The overcap also includes an outer skirt offset from the inner skirt to project downward over the bottle.

In some embodiments, an overcap for a bottle is disclosed. The overcap includes an outer skirt. The overcap also includes an inner skirt having a first engaging lip and a second engaging lip. The engaging lips extend inwardly. The outer skirt includes a bottom that extends lower than a bottom of the inner skirt.

BRIEF DESCRIPTION OF THE DRAWINGS

Various other features and attendant advantages of the present invention will be more fully appreciated when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. Numerous specific details are set forth in order to provide a thorough understanding of the present invention. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Figure 1:
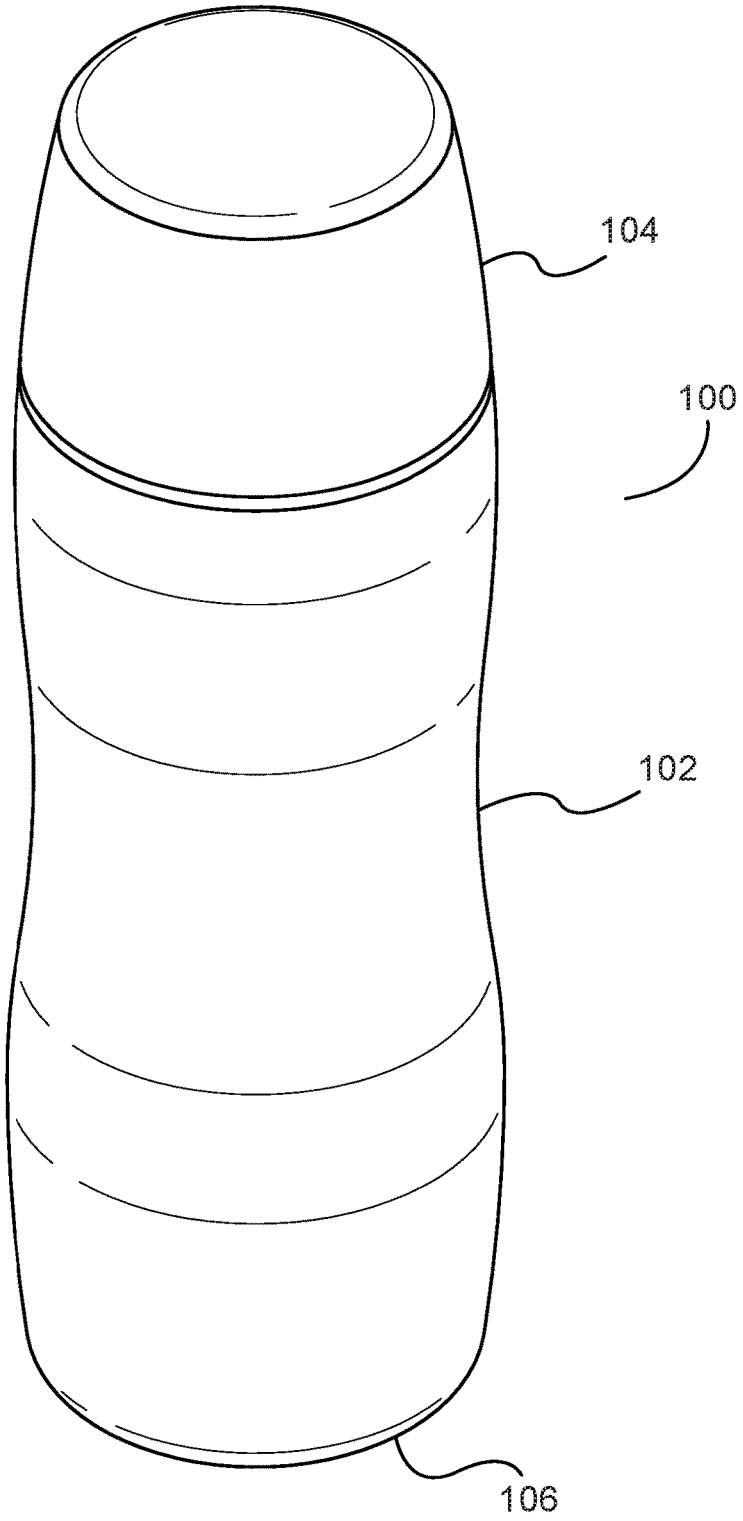
FIG. 1 illustrates a view of a bottle with an overcap according to the disclosed embodiments.

FIG. 1 depicts a bottle 100 with an overcap 104 according to the disclosed embodiments. Bottle 100 may be configured to hold fluids, such as water, juice, milk, sports drink, soda, and the like. A user opens bottle 100 by removing overcap 104. Overcap 104 may twist off from body 102 of bottle 100. Body 102 actually holds the fluid within bottle 100. In some embodiments, body 102 is composed of PET (polyethene terephthalate) and may be called PETE while overcap 104 is composed of PP (polypropylene). Other materials may be used for bottle 100, including using the same materials for body 102 and overcap 104.

Bottle 100 also includes a base 106 that allows the bottle to be placed on a surface. Base 106 may include a resting point, which is the extreme outside edge of the base. In some embodiments, base 106 may include a kick-up or push-up portion. A kick-up or push-up portion of base 106 rises into body 102. It may somewhat reduce the interior volume of bottle 100 but provides greater stability and strength. The kick-up or push-up portion also may prevent content sedimentation.

As shown in FIG. 1, overcap 104 covers a top portion of bottle 102. This top portion is disclosed in greater detail below. Overcap 104 engages features of bottle 100 and then extends outwardly then downwardly from the mouth of the bottle. In some embodiments, a user grasps bottle 100 by overcap 104. Overcap 104 should fit within a palm of a hand of the user. In some embodiments, overcap 104 also includes different color or shading than body 102 so that the user can readily identify it. Further, the user will be prompted to place bottle 100 on base 106, and not overcap 104. The user sees the different color of overcap 104 and understands that it is the top of bottle 100.

One problem with conventional overcaps is that the items tend to disengage with the bottle while being carried. In short, the overcap slips right off the body. Bottle 100 prevents that with an overcap 104 that secures to body 102 via the closure (disclosed in greater detail below). Thus, body 102 of bottle 100 may not slip from overcap 104 to spill its contents or hit something.

Figure 2:
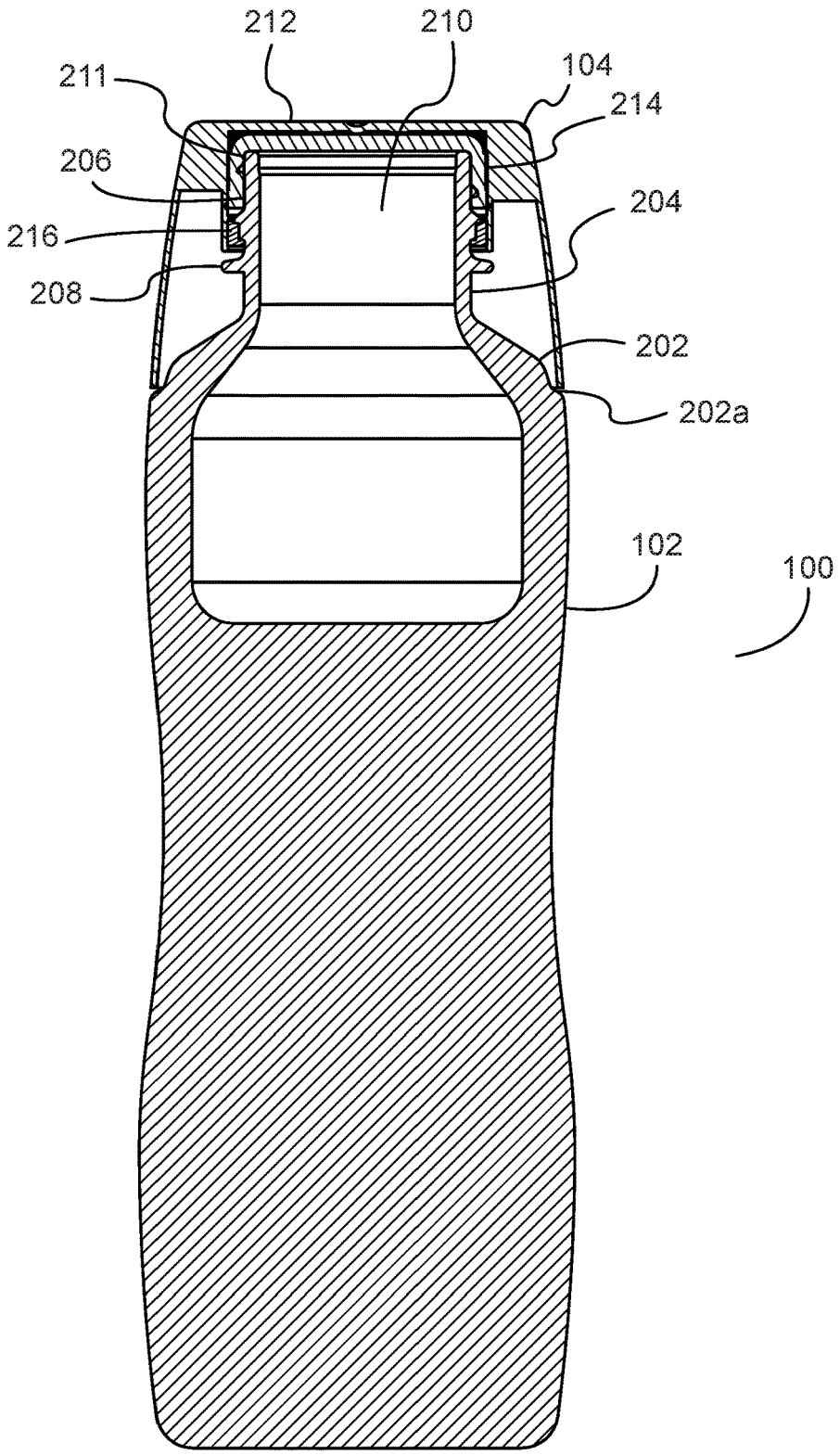
FIG. 2 illustrates another view of the bottle with the overcap according to the disclosed embodiments.

FIG. 2 depicts another view of bottle 100 having overcap 104 according to the disclosed embodiments. FIG. 2 shows the features of bottle 100 in greater detail. Bottle 100 includes body 102 that is connected to shoulder 202. Shoulder 202 is the portion of bottle 100 that includes a change in vertical tangency to the base of neck 204. Shoulder 202 indicates a transition zone between the two other major portions of bottle 100. Shoulder 202 may include indentation 202*a* that allow overcap 104 to fit over the shoulder and be flush with body 102. Indentation 202*a* prevents overcap 104 from sticking outwards from body 102.

Neck 204 includes finish 206, collar 208, and lip 211 that shapes mouth 210. In some embodiments, finish 206 may be considered separate from neck 204. Neck 204 has a smaller diameter than body 102 so as to funnel the fluid within bottle 100 to mouth 210. Neck 204 tapers inwardly from shoulder 202 then extends upwards in the vertical direction. Lip 211 may refer to the topmost portion of neck 204 that surrounds mouth 210.

Finish 206 may refer to the portion of bottle 100 above collar 208. Collar 208 may be a piece that encircles neck 204. Finish 206 engages closure 212. In some embodiments, finish 206 includes an externally threaded finish. In these embodiments, finish 206 may be a continuous external thread finish that includes a continuous spiral projecting portion or ridge intended to mesh with the thread of a screw-type closure 212. A continuous thread may be one uninterrupted ridge of the material for bottle 100 that wraps around the outside circumference of neck 204 for at least one and sometimes two full turns. Alternatively, finish 206 may be a interrupted or discontinuous thread that includes gaps to create a series of short to moderate length thread ridges that are not connected to each other.

Closure 212 covers mouth 210 and engages finish 206 to close bottle 100. Closure 212 is removable. In some embodiments, closure 212 includes ridges that abut the ridges of finish 206. This part of closure 212 may be known as cover 214. Closure 212 also include tamper-proof band 216. Tamper-proof band 216 is detachable from cover 214 so that it remains on finish 206 when the cover is detached from neck 204. Tamper-proof band 216 may indicate to a user whether bottle 100 has been opened. Tamper-proof band 216 may rest against collar 208. In some embodiments, tamper-proof band 216 includes teeth that extend inwardly to contact neck 204 but do not move in relation to finish 206.

As can be seen in FIG. 2, overcap 104 extends outwardly from neck 204 and then downward to enclose neck 204 and shoulder 202. In this configuration, overcap 104 provides a bottle 100 having a substantial uniform shape and diameter. It also allows a user to grasp bottle 100 without directly engaging closure 212. This prevents closure 212 from loosening or being opened accidently. Overcap 104 also provides protection to closure 212 so that it is not exposed directly to the outside and may be kept dry, clean, and the like.

Figure 3:
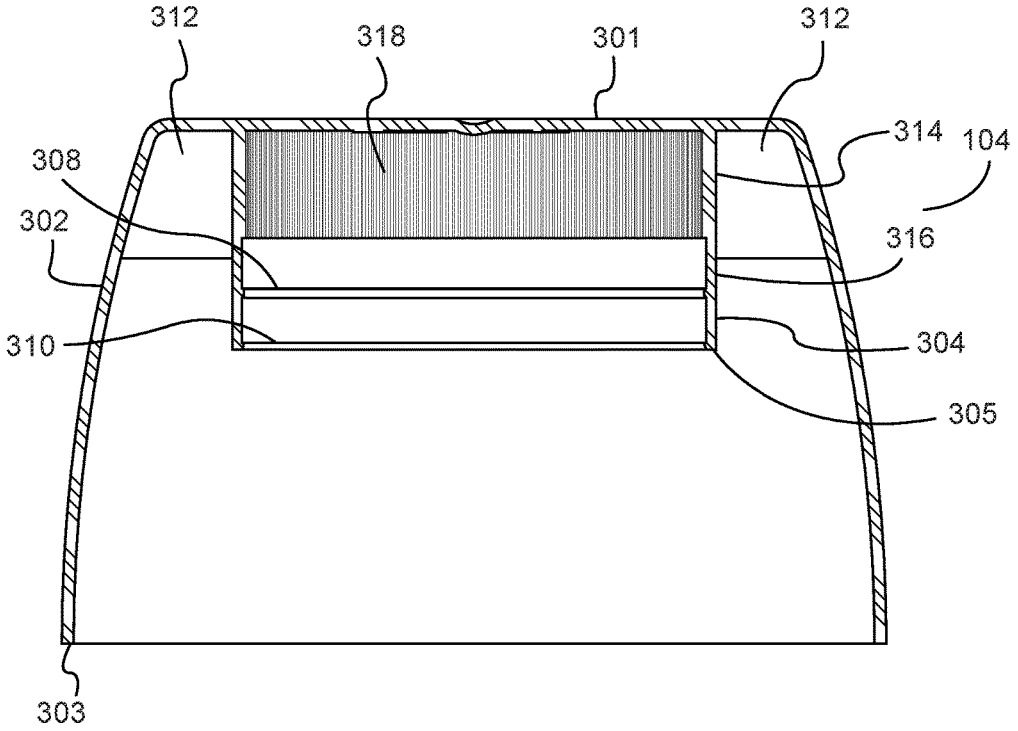
FIG. 3 illustrates a cross-sectional view of the overcap according to the disclosed embodiments.

Overcap 104 is disclosed in greater detail by FIG. 3. FIG. 3 depicts a cross-sectional view of overcap 104 according to the disclosed embodiments. FIG. 4 depicts a bottom view of overcap 104 according to the disclosed embodiments. Overcap 104 includes a top portion 301, an outer skirt 302, and an inner skirt 304. Overcap 104 also may include offset portion 312 between outer skirt 302 and inner skirt 304 that includes top portion 301.

As shown, outer skirt 302 extends downward along bottle 100 farther than inner skirt 304. Thus, a bottom 303 of outer skirt 302 extends further, or lower, than a bottom 305 of inner skirt 304. This feature allows outer skirt 302 to enclose shoulder 202 and neck 204 while inner skirt 304 engages with finish 206. Outer skirt 302 also extends outwardly from top portion 301.

Inner skirt 304 includes an upper portion 314 and a lower portion 316. Upper portion 314 includes teeth 318 that ribs or teeth on the outside of cover 214. Teeth 318 interact or engage with cover 214 to twist closure 212 on and off finish 206. Upper portion 314 fits over cover 214 and may secure it so that it remains within inner skirt 304 when removed from bottle 100. This feature allows for easier twist on and off of cover 214 and also prevents the user from scraping his/her hand when removing closure 212. Inner skirt 304 is substantially perpendicular to top portion 301.

Lower portion 316 includes a first engaging lip 308 and a second engaging lip 310. Engaging lips may be disclosed in greater detail below. Engaging lips 308 and 310 act as ledges or ridges that project inwardly from inner skirt 304. First engaging lip 308 may be located above second engaging lip 310 on inner skirt 304. First engaging lip 308 engages closure 212 by fitting below cover 214. Second engaging lip 310 engages tamper-proof band 216 by fitting below the band but above collar 208. In other words, first engaging lip 308 fits between cover 214 and tamper-proof band 216 while second engaging lip 310 fits between the tamper-proof band and collar 208. As noted above, tamper-proof band 216 is not removed from bottle 100 when cover 214 is off finish 206.

Using this configuration, inner skirt 304 provides increased security for overcap 104. Overcap 104 may not be inadvertently pulled off by the hand of a user. While grasping overcap 104, body 102 may not dislodge and pull apart. Absent the twisting action on overcap 104 to move cover 214 using teeth 318 of upper portion 314 of inner skirt 304, bottle 100 stays whole and does not separate. This feature prevents accidents and spills that may occur in other overcap configurations. Moreover, overcap 104 is easier to grasp with the hand than normal bottles with closures.

Figure 4A:
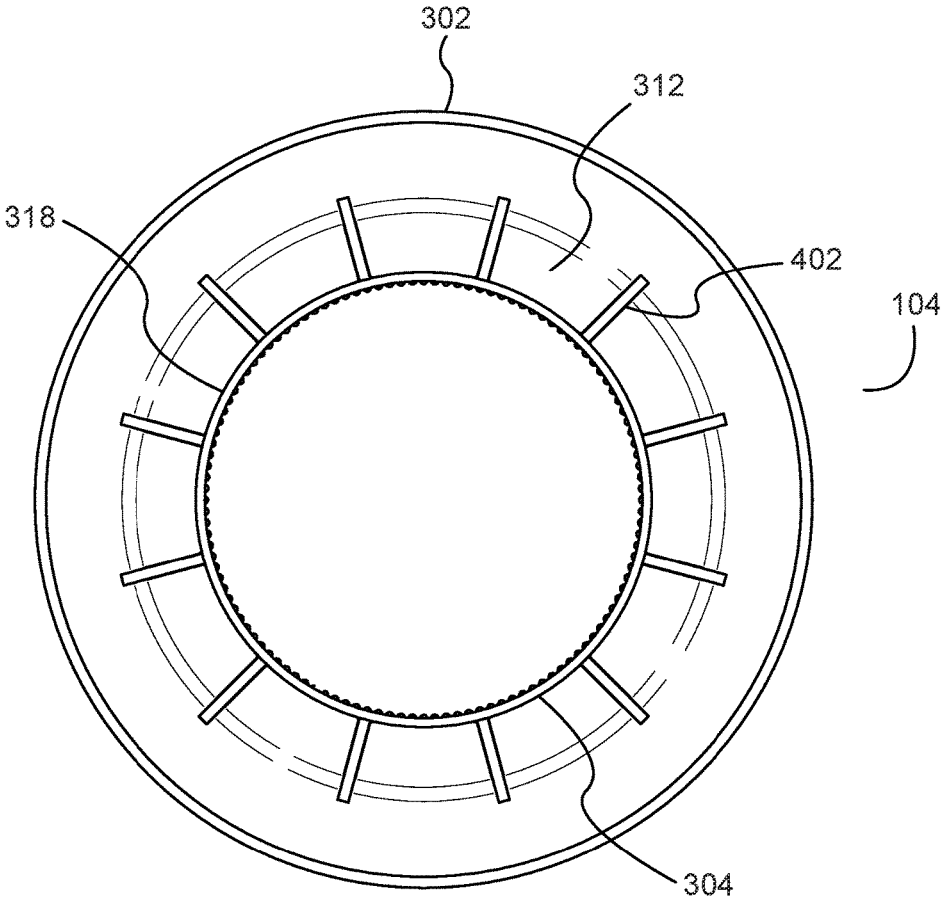
FIG. 4A illustrates a bottom view of the overcap according to the disclosed embodiments.

Referring to FIG. 4A, ribs 402 are shown between outer skirt 302 and inner skirt 304. Ribs 402 may define offset portion 312 that expands the size to fit easily within the hand of a user. Ribs 402 also may provide reinforcement to keep outer skirt 302 from being bent or pressed inwardly towards inner skirt 304. In some embodiments, ribs 402 are straight sections connected between inner skirt 304 and outer skirt 302.

Figure 4B:
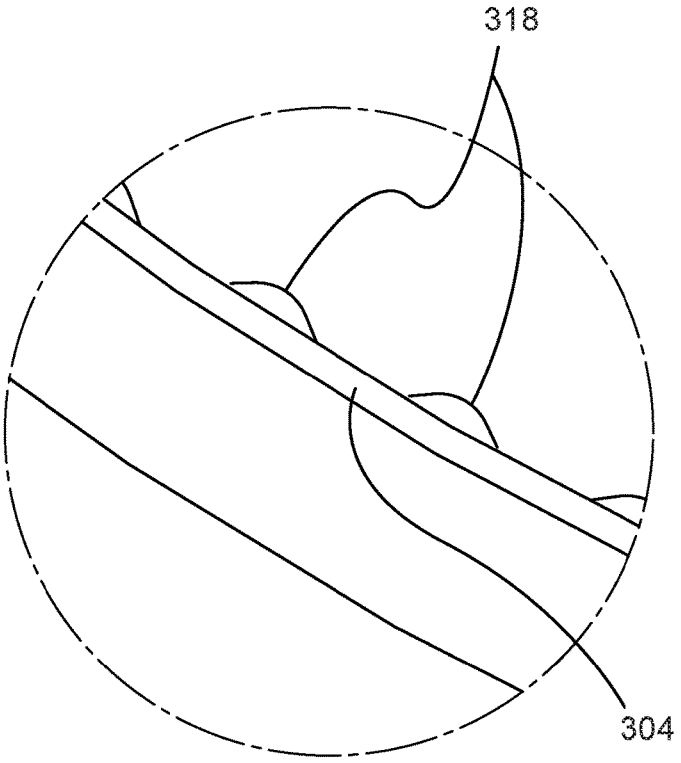
FIG. 4B illustrates teeth of the inner skirt in greater detail.

FIG. 4B depicts teeth 318 of inner skirt 304 in greater detail. As shown, teeth 318 project outwardly from inner skirt 304. They engage ribs or teeth on cover 214. When overcap 104 is twisted on or off, teeth 318 move against the ribs or teeth on cover 214 to move it in a desired direction. First engaging lip 308, however, keeps cover 214 embedded within inner skirt 304.

Figure 5:
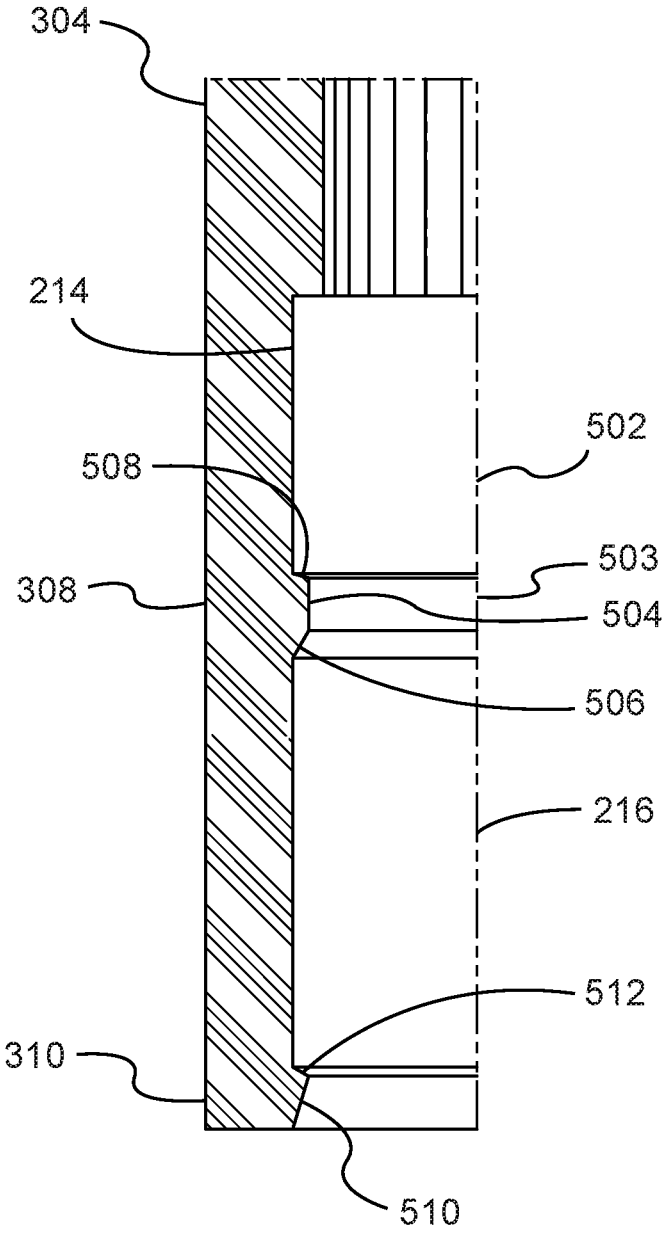
FIG. 5 illustrates an exploded view of a first engaging lip and a second engaging lip according to the disclosed embodiments.

FIG. 5 depicts an exploded view of first engaging lip 308 and second engaging lip 310 according to the disclosed embodiments. As shown, first engaging lip 308 engages cover 214 while second engaging lip 310 engages tamper-proof band 216. These embodiments are disclosed in greater detail.

First engaging lip 308 actually engages a bottom 502 of cover 214. First engaging lip 308 projects inwardly toward section 503 of neck 204 that is not covered by cover 214 or tamper-proof band 216. First engaging portion 308 includes a facing portion 504 that faces towards neck 204. Facing portion 504 may be substantially straight or perpendicular to top portion 301 of overcap 104.

A slanted upper portion 508 of first engaging lip 308 may extend downwardly from inner skirt 304 to facing portion 504. Slanted upper portion 508 may abut bottom 502 of cover 214. In some embodiments, slanted upper portion 508 may extend downwardly at an angle from about 12 degrees to about 18 degrees, or, more preferably, at an angle about 15 degrees. This angle allows first engaging lip 308 to receive bottom 502 in a manner to secure inner skirt 304 to closure 212. A greater angle may allow inner skirt 304 to slip over cover 214 more easily. Cover 214 should stay embedded within inner skirt 304 when overcap 104 is disengaged from bottle 100.

First engaging lip 308 also includes a slanted lower portion 506 that extends upwardly from inner skirt 304 to facing portion 504. Slanted lower portion 506 may abut the top of tamper-proof band 216. In some embodiments, slanted lower portion 506 extends upwardly at an angle from about 20 degrees to about 40 degrees, or, preferably, at about 30 degrees. This angle allows a better area of engagement between slanted lower portion 506 and the top of tamper-proof band 216.

Second engaging lip 310 includes a slanted upper portion 512 and a slanted lower portion 510. Although not shown, second engaging lip 310 may include a facing portion. Second engaging lip 310 engages the bottom of tamper-proof band 216, preferably above collar 208. When tamper-proof band 216 separates from cover 214, inner skirt 304 still may secure itself using second engaging lip 310. Second engaging lip 310 provides extra support to secure overcap 104 to bottle 100.

Slanted upper portion 512 may extend downwardly from inner skirt 304 to intersect with slanted lower portion 510, which extends upwardly. The intersection occurs in a location proximate the bottom of tamper-proof band 216. The slanted portions allow second engaging lip 310 to be placed between tamper-proof band 216 and collar 208. Slanted upper portion 512 may extend downwardly at an angle from about 20 degrees to about 40 degrees, or, preferably, at an angle of about 30 degrees. Slanted lower portion 510 may extend upwardly at an angle from about 12 degrees to about 18 degrees, or, preferably, at an angle of about 16 degrees. The angle for slanted upper portion 512 allows inner skirt 304 to move over tamper-proof band 216. This angle is greater than the angle for slanted upper portion 508 as tamper-proof band 216 is not meant to stay embedded in inner skirt 304.

Thus, the disclosed embodiments provide a structure that allows overcap 104 to remain fixed or secured to finish 206 and neck 204 of bottle 100. Overcap 104 is not pulled off by normal activity or grasping bottle 100. Instead, cover 214 is removed when overcap 104 is twisted off.

It will be apparent to those skilled in the art that various modifications to the disclosed may be made without departing from the spirit or scope of the invention. Thus, it is intended that the present invention covers the modifications and variations disclosed above provided that these changes come within the scope of the claims and their equivalents.

The invention claimed is:

1. A bottle comprising:

a body to hold a fluid;

a base located below the body;

a shoulder located opposite the base and connected to the body;

a neck connected to the shoulder, wherein the neck includes a finish and a collar;

a mouth within the neck to allow access to the body;

a closure to engage the finish so as to close the mouth, wherein the closure includes a cover and a tamper-proof band; and an overcap coupled with the closure, the overcap including an outer skirt to flare outwardly from the mouth to cover the neck and the shoulder;

an inner skirt to engage the cover and tamper-proof band, wherein the inner skirt includes a first engaging lip to engage the cover and a second engaging lip to engage the tamper-proof band.

2. The bottle of claim 1, wherein the overcap includes an offset portion between the outer skirt and the inner skirt.

3. The bottle of claim 2, wherein the offset portion includes ribs extending outwardly from the inner skirt to the outer skirt.

4. The bottle of claim 1, wherein an upper portion of the inner skirt above the first engaging lip includes teeth to engage the cover.

5. The bottle of claim 1, wherein the first engaging lip engages a bottom of the cover.

6. The bottle of claim 1, wherein the first engaging lip includes a first slanted lower portion and a facing portion.

7. The bottle of claim 6, wherein the first slanted lower portion is located below the facing portion and extends toward the finish of the neck.

8. The bottle of claim 6, wherein the first engaging lip includes a first slanted upper portion extending downwardly from the inner skirt to the facing portion.

9. The bottle of claim 1, wherein the second engaging lip engages a bottom of the tamper-proof band.

10. The bottle of claim 1, wherein the second engaging lip includes a second slanted upper portion and a second slanted lower portion.

11. The bottle of claim 10, wherein the second slanted upper portion and the second slanted lower portion intersect proximate the tamper-proof band.

12. An overcap to engage a closure of a bottle, the overcap comprising:

an inner skirt to engage a cover and a tamper-proof band of the closure, wherein the inner skirt includes a first engaging lip and a second engaging lip; and an outer skirt connected by an offset to the inner skirt, the outer skirt to project downward over the bottle.

13. The overcap of claim 12, wherein the inner skirt includes an upper portion with teeth and a lower portion without teeth, in which the first engaging lip and the second engaging lip are within the lower portion and wherein the teeth extend toward an inner portion of the inner skirt.

14. The overcap of claim 12, wherein the first engaging lip is located opposite the cover.

15. The overcap of claim 12, wherein the second engaging lip is located opposite the tamper-proof band.

16. The overcap of claim 12, wherein the first engaging lip and the second engaging lip project inwardly from the inner skirt.

17. An overcap for a bottle comprising:

an outer skirt; and an inner skirt having a first engaging lip and a second engaging lip, wherein the engaging lips extend inwardly and each engaging lip includes a slanted upper portion, wherein the outer skirt includes a bottom that extends lower than a bottom of the inner skirt.

18. The overcap of claim 17, further comprising an offset portion to connect the outer skirt and the inner skirt.

19. The overcap of claim 17, further comprising a top portion, wherein the inner skirt is substantially perpendicular to the top portion.

20. The overcap of claim 19, wherein the outer skirt extends outwardly from the top portion.

* * * * *